US011315586B2

(12) United States Patent
Huang et al.

(10) Patent No.: US 11,315,586 B2
(45) Date of Patent: Apr. 26, 2022

(54) APPARATUS AND METHOD FOR MULTIPLE-MICROPHONE SPEECH ENHANCEMENT

(71) Applicant: BRITISH CAYMAN ISLANDS INTELLIGO TECHNOLOGY INC., Grand Cayman (KY)

(72) Inventors: Bing-Han Huang, Zhubei (TW); Chun-Ming Huang, Zhubei (TW); Te-Lung Kung, Zhubei (TW); Hsin-Te Hwang, Zhubei (TW); Yao-Chun Liu, Zhubei (TW); Chen-Chu Hsu, Zhubei (TW); Tsung-Liang Chen, Zhubei (TW)

(73) Assignee: British Cayman Islands Intelligo Technology Inc., Grand Cayman (KY)

( * ) Notice: Subject to any disclaimer, the term of this patent is extended or adjusted under 35 U.S.C. 154(b) by 0 days.

(21) Appl. No.: 17/039,445

(22) Filed: Sep. 30, 2020

(65) Prior Publication Data

US 2021/0125625 A1 Apr. 29, 2021

Related U.S. Application Data

(60) Provisional application No. 62/926,556, filed on Oct. 27, 2019.

(51) Int. Cl.
*G10L 21/0208* (2013.01)
*G10L 25/21* (2013.01)
*G10L 25/30* (2013.01)

(52) U.S. Cl.
CPC ..... *G10L 21/0208* (2013.01); *G10L 25/21* (2013.01); *G10L 25/30* (2013.01)

(58) Field of Classification Search
CPC ..... G10L 21/0208; G10L 25/21; G10L 25/30
See application file for complete search history.

(56) References Cited

U.S. PATENT DOCUMENTS 10,083,707 B1 9/2018 Ou
10,424,315 B1 * 9/2019 Ganeshkumar ..... H03G 5/165
(Continued)

FOREIGN PATENT DOCUMENTS

TW I639154 B 10/2018

OTHER PUBLICATIONS

Valin; "A Hybrid DSP/Deep Learning Approach to Real-Time Full-Band Speech Enhancement", 2018 IEEE 20th International Workshop on Multimedia Signal processing (MMSP), 2018 (pp. 5).
(Continued)

*Primary Examiner* — Bryan S Blankenagel
(74) *Attorney, Agent, or Firm* — Muncy, Geissler, Olds & Lowe, P.C.

(57) ABSTRACT

A speech enhancement apparatus is disclosed and comprises an adaptive noise cancellation circuit, a blending circuit, a noise suppressor and a control module. The ANC circuit filters a reference signal to generate a noise estimate and subtracts a noise estimate from a primary signal to generate a signal estimate based on a control signal. The blending circuit blends the primary signal and the signal estimate to produce a blended signal. The noise suppressor suppresses noise over the blended signal using a first trained model to generate an enhanced signal and a main spectral representation from a main microphone and M auxiliary spectral representations from M auxiliary microphones using (M+1) second trained models to generate a main score and M auxiliary scores. The ANC circuit, the noise suppressor and the trained models are well combined to maximize the performance of the speech enhancement apparatus.

27 Claims, 10 Drawing Sheets

(56) References Cited

U.S. PATENT DOCUMENTS

| | | | | |
|---|---|---|---|---|
| 2013/0114821 | A1* | 5/2013 | Hamalainen | G10K 11/1783 381/71.6 |
| 2013/0191119 | A1* | 7/2013 | Sugiyama | G10L 21/0208 704/226 |
| 2015/0195646 | A1* | 7/2015 | Kumar | G10K 11/17821 381/71.8 |
| 2020/0302922 | A1* | 9/2020 | Jazi | G10L 25/84 |

OTHER PUBLICATIONS

Kokkinaskis; "Single and Multiple Microphone Noise Reduction Strategies in Cochlearimplants", https://www.ncbi.nlm.nih.gov/pmc/article/PMC3691954/; Trends in Hearing, SAGE,2012, (pp. 25).

White Paper; "Dual microphone adaptive noise reduction software paper", VOCAL Technologies, Ltd.; http://www.VOCAL.com; Dec. 15, 2015; (pp. 8).

Marco Jeub et al; "Noise reduction for dual-microphone mobile phones exploiting power level differences,"; Conference Paper in Acoustics, Speech, and Signal Processing, 1988. ICASSP-88., 1988 International Conference on • May 2012; (pp. 5).

* cited by examiner

APPARATUS AND METHOD FOR MULTIPLE-MICROPHONE SPEECH ENHANCEMENT

CROSS-REFERENCE TO RELATED APPLICATION

This application claims priority under 35 USC 119(e) to U.S. provisional application No. 62/926,556, filed on Oct. 27, 2019, the content of which is incorporated herein by reference in its entirety.

BACKGROUND OF THE INVENTION

Field of the Invention

The invention relates to speech processing, and more particularly, to an apparatus and method for multiple-microphone speech enhancement.

Description of the Related Art

Speech enhancement is a precursor to various applications like hearing aids, automatic speech recognition, teleconferencing systems, and voice over internet protocol (VoIP). Speech enhancement is to enhance the quality and intelligibility of speech signals. Specifically, the goal of speech enhancement is to clean the audio signal from a microphone and then send the clean audio signal to listeners or downstream applications.

In our daily life, mobile phones are often used in many environments where high level of background noise is present. Such environments are common in cars (which is increasingly becoming hands-free), or in the street, whereby the communication system needs to operate in the presence of high levels of car noise or street noise. Other types of high-level ambient noises can be also experienced in practice. To increase performance in noise, conventional single-microphone and dual-microphone noise reduction approaches are conducted based on the assumption that noise power is less than speech power. If the noise is stationary, the conventional single-microphone noise reduction approaches can identify raised stationary noises to give satisfactory results, but it may not be the case for the nonstationary scenario. For dual-microphone speech system, the normalized least mean squares (NLMS) is commonly used to determine an optimal filter for an adaptive noise canceller (ANC). However, as well known in the art, NLMS takes time to converge. Training of the adaptive filter in the ANC needs to be stopped when speech is present because the speech is uncorrelated with the noise signal and will cause the adaptive filter to diverge. Voice activity detectors (VAD) are necessary for detecting whether speech is present because the speech signal can potentially leak into the noise reference signal. Adaption needs to be stopped during voice active periods (i.e., speech is present) to prevent self-cancellation of the speech. The ANC in cooperation with the VAD has the following drawbacks. First, a high-level background noise may cause the VAD to make wrong decisions, thus affecting the operations of the adaptive filter. Second, the VAD may mistakenly treat a sudden noise (e.g., tapping noise) as speech and cause the adaptive filter to stop. Third, if a person keeps speaking from the beginning, the adaptive filter is unable to converge and the ANC stops operating. Thus, it is clear that the dual-microphone speech system including the VAD and the ANC operates under limited circumstances.

What is needed is an apparatus and method for multiple-microphone speech enhancement applicable to any environments, regardless the noise type and whether the noise power is larger than the speech power.

SUMMARY OF THE INVENTION

In view of the above-mentioned problems, an object of the invention is to provide a speech enhancement apparatus capable of well combining an adaptive noise cancellation (ANC) circuit, a noise suppressor and a beamformer to maximize its performance.

One embodiment of the invention provides a speech enhancement apparatus. The apparatus comprises an adaptive noise cancellation (ANC) circuit, a blending circuit, a noise suppressor and a control module. The ANC circuit has a primary input and a reference input. The ANC circuit filters a reference signal from the reference input to generate a noise estimate and subtracts the noise estimate from the primary signal to generate a signal estimate in response to a control signal. The blending circuit blends the primary signal and the signal estimate to produce a blended signal according to a blending gain. The noise suppressor is configured to suppress noise over the blended signal using a noise suppression section to generate an enhanced signal and to respectively process a main spectral representation of a main audio signal from a main microphone and M auxiliary spectral representations of M auxiliary audio signals from M auxiliary microphones using (M+1) classifying sections to generate a main score and M auxiliary scores. The control module is configured to perform a set of operations comprising: generating the blending gain and the control signal according to the main score, a selected auxiliary score, an average noise power spectrum of a selected auxiliary audio signal, and characteristics of current speech power spectrums of the main spectral representation and a selected auxiliary spectral representation. The selected auxiliary score and the selected auxiliary spectral representation correspond to the selected auxiliary audio signal out of the M auxiliary audio signals.

Another embodiment of the invention provides a speech enhancement method. The method comprises: respectively processing a main spectral representation of a main audio signal from a main microphone and M auxiliary spectral representations of M auxiliary audio signals from M auxiliary microphones using (M+1) classifying processes to generate a main score and M auxiliary scores; generating a blending gain and the control signal according to the auxiliary score, a selected auxiliary score, an average noise power spectrum of a selected auxiliary audio signal, and characteristics of current speech power spectrums of the main spectral representation and a selected auxiliary spectral representation, wherein the selected auxiliary score and the selected auxiliary spectral representation corresponds to the selected auxiliary audio signal out of the M auxiliary audio signals; controlling an adaptive noise cancellation process by the control signal for filtering a reference signal to generate a noise estimate and for subtracting the noise estimate from a primary signal to generate a signal estimate; blending the primary signal and the signal estimate to produce a blended signal according to the blending gain; and, suppressing noise over the blended signal using a noise suppression process to generate an enhanced signal.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
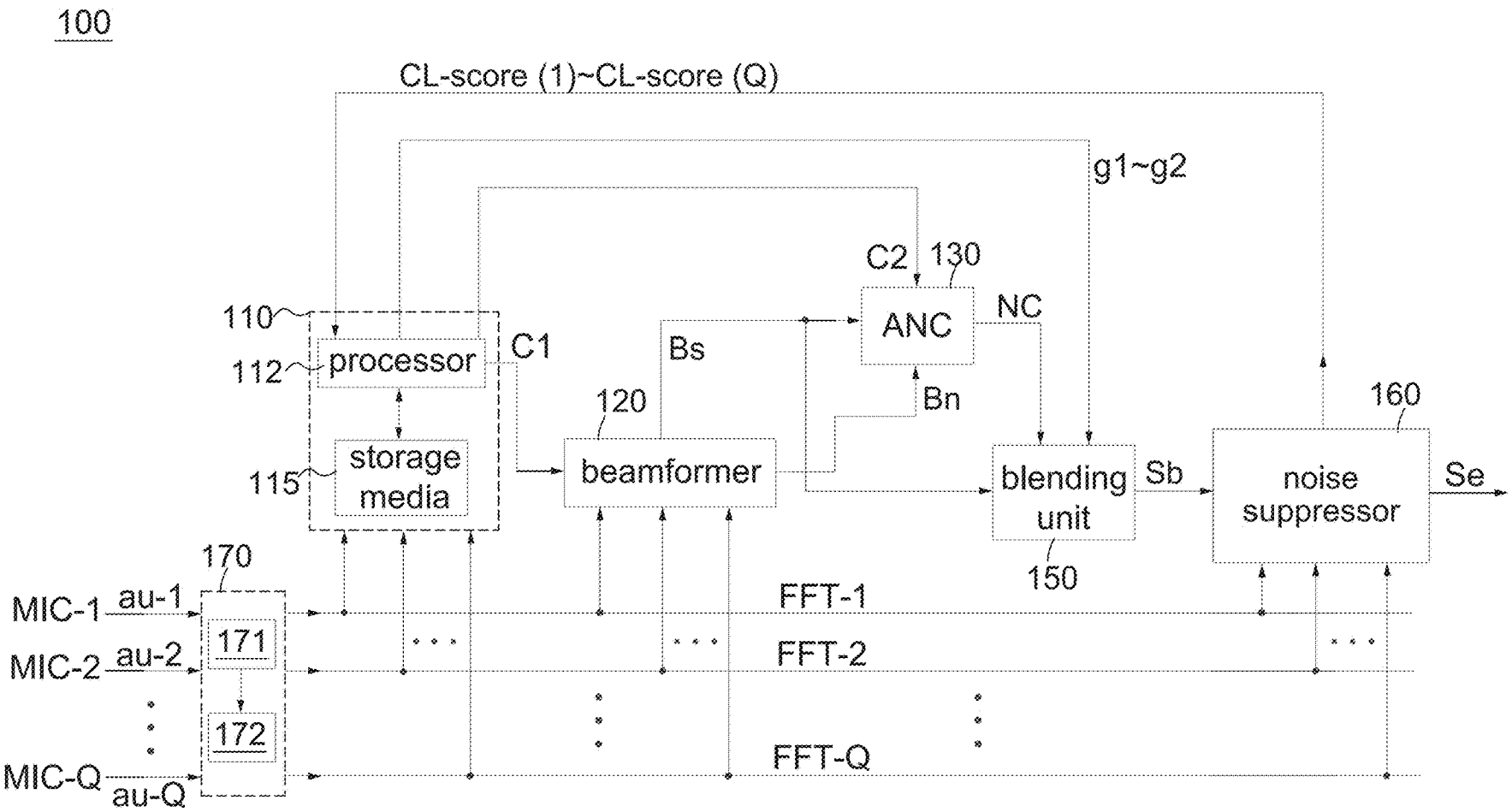
FIG. 1 is a schematic diagram showing a multiple-microphone speech enhancement apparatus according to an embodiment of the invention.

As used herein and in the claims, the term "and/or" includes any and all combinations of one or more of the associated listed items. The use of the terms "a" and "an" and "the" and similar referents in the context of describing the invention are to be construed to cover both the singular and the plural, unless otherwise indicated herein or clearly contradicted by context. Throughout the specification, the same components and/or components with the same function are designated with the same reference numerals.

A feature of the invention is to suppress all kinds of noise (including interfering noise) regardless of the noise type and whether its noise power level is larger than its speech power level. Another feature of the invention is to use a classifying section (16*a*2/16*b*2/16*c*2/16*d*2) to correctly classify each of multiple frequency bands contained in each frame of an input audio signal as speech-dominant or noise-dominant. Another feature of the invention is to include a neural network-based noise suppressor to correctly suppress noise from its input audio signal according to classification results of the neural network 240 to improve noise suppression performance. The classification results (i.e., CL-score (i)) of the classifying section (16*a*2/16*b*2/16*c*2/16*d*2) greatly assist the control module 110 in determining an input audio signal is noise-dominant or speech-dominant and whether to activate the ANC 130. Another feature of the invention is to well arrange multiple microphone locations so that the auxiliary microphones receive the user's speech as little as possible. Another feature of the invention is to include a beamformer to enhance the speech component in a filtered speech signal Bs and suppress/eliminate the speech component in a filtered noise signal Bn (see FIG. 1), thus avoiding the speech component from being eliminated in the operations of the ANC. Another feature of the invention is to combine the advantages of the ANC, the beamformer, the neural network-based noise suppressor and the trained models to optimize the performance of speech enhancement.

FIG. 1 is a schematic diagram showing a multiple-microphone speech enhancement apparatus according to an embodiment of the invention. Referring to FIG. 1, a multiple-microphone speech enhancement apparatus 100 of the invention includes a control module 110, a beamformer 120, an adaptive noise canceller (ANC) 130, a blending unit 150, a noise suppressor 160 and a pre-processing circuit 170.

The pre-processing circuit 170 includes an analog-to-digital converter (ADC) 171 and a transformer 172. The ADC 171 respectively converts Q analog audio signals (au-1~au-Q) received from microphones (MIC-1~MIC-Q) into Q digital audio signals. The transformer 172 is implemented to perform a fast Fourier transform (FFT), a short-time Fourier transform (STFT) or a discrete Fourier transform (DFT) over its input signals. For purpose of clarity and ease of description, hereinafter, the following examples and embodiments will be described with the transformer 172 performing the FFT operations over its input signals. Specifically, the transformer 172 respectively converts (i.e, performing FFT operations over) audio data of current frames of the Q digital audio signals in time domain into complex data in frequency domain. Assuming a number of sampling points (or Fast Fourier Transform (FFT) size) is N and the time duration for the current frame is Td, the transformer 172 respectively divides the digital audio signals into a plurality of frames (each frame having R (<=N) samples in time domain) and computes the FFT of the current frame of each audio signal (au-1~au-Q) to generate a spectral representation having N complex-valued samples (hereinafter called "FFT-1~FFT-Q" for short) with a frequency resolution of fs/N(=1/Td). Here, fs denotes a sampling frequency of the ADC 171. For example, a spectral representation having the N complex-valued samples for the current frame of audio signal au-1 is hereinafter called FFT-1 for short, a spectral representation having the N complex-valued samples for the current frame of audio signal au-2 is hereinafter called FFT-2 for short, and so forth. After that, the pre-processing circuit 170 respectively transmits the Q current spectral representations (FFT-1~FFT-Q) of the Q current frames of the Q audio signals (au-1~au-Q) to downstream components, i.e., the control module 110, the beamformer 120 and the noise suppressor 160. In a preferred embodiment, the time duration Td of each frame is about 8~32 milliseconds (ms). Please note that due to the fact that the control module 110, the beamformer 120 and the noise suppressor 160 receive and manipulate the current spectral representations (FFT-1~FFT-Q), the related signals Bs, Bn, NC and Sb are also frequency domain signals.

Each of the control module 110, the beamformer 120, the ANC 130, the blending unit 150 and pre-processing circuit 170 may be implemented by software, hardware, firmware, or a combination thereof. In an embodiment, the control module 110 is implemented by a processor 112 and a storage media 115. The storage media 115 stores instructions/program codes operable to be executed by the processor 112 to cause the processor 112 to perform all the steps of the methods in FIGS. 3A-3B. The control module 110 is able to correctly classify the ambient environment into multiple scenarios according to the classification results (CL-scores (1)~(Q)) and the current spectral representations (FFT-1~FFT-Q), and respectively sends two control signals C1~C2 and two gain values g1~g2 to the beamformer 120, the ANC 130 and the blending unit 150 according to the classified scenario.

Base on the control signal C1, the beamformer 120 performs spatial filtering by linearly combining the Q current spectral representations (FFT-1~FFT-Q) of the Q current frames of a main audio signal au-1 and (Q−1) auxiliary audio signals (au-2~au-Q) to produce a filtered speech signal Bs and a filtered noise signal Bn. The ANC 130 produces a noise estimate by filtering the filtered noise signal Bn (from the reference input) and subtracts the noise estimate from the filtered speech signal Bs (from the primary input) to generate a signal estimate NC. The blending unit 150 blends the signal estimate NC and the filtered speech signal Bs according to the two gain values g1~g2 to generate the blended signal Sb. Finally, the noise suppressor 160 suppresses noise from its input audio signal Sb based on its classification results (CL-score) from its noise suppression section (16*a*1/16*b*1/16*c*1/16*d*1) to generate an enhanced signal Se, and processes the current spectral representations (FFT-1~FFT-Q) with its Q classifying sections (16*ba*2/16*b*2/16*c*2/16*d*2) to generate Q classification results (CL-score (1)~CL-score (Q)).

The speech enhancement apparatus 100 can be applied within a number of computing systems, including, without limitation, general-purpose computing systems, communication systems, hearing aids, automatic speech recognition (ASR), teleconferencing systems, automated voice service systems and speech processing systems. The communication systems include, without limitation, mobile phones, VoIP, hands-free phones and in-vehicle cabin communication systems. For purpose of clarity and ease of description, hereinafter, the following examples and embodiments will be described with the assumption that the multiple-microphone speech enhancement apparatus 100 is applied in a mobile phone (not shown).

Q microphones including a main microphone MIC-1 and (Q−1) auxiliary microphones MIC-2~MIC-Q are placed at different locations on the mobile phone, where Q>1. The main microphone MIC-1 closest to the user's mouth is used to capture the user's speech signals. In actual implementations, the Q microphones are well arranged so that the distances between the (Q−1) auxiliary microphones and the user's mouth are Z times longer than the distance between the main microphone MIC-1 and the user's mouth, where Z>=2 and Z is a real number. In such a manner, the (Q−1) auxiliary microphones receive the user's speech as little as possible. For example, if Q=2, a main microphone MIC-1 is mounted on the bottom of the mobile phone while an auxiliary microphone MIC-2 is mounted in an upper part of the rear side of the mobile phone. The microphones (MIC-1~MIC-Q) may be any suitable audio transducer for converting sound energy into electronic signals. Audio signals (au-1~au-Q) captured by the microphones (MIC-1~MIC-Q) located nearby normally capture a mixture of sound sources. The sound sources may be noise like (ambient noise, street noise or the like) or a voice.

Base on the control signal C1, the beamformer 120 is configured to perform spatial filtering by linearly combining the current spectral representations (FFT-1~FFT-Q) of the current frames of the main audio signal au-1 and (Q−1) auxiliary audio signals (au-2~au-Q) to produce a filtered speech signal Bs and a filtered noise signal Bn. The spatial filtering enhances the reception of signals (e.g., improving the SNR) from a desired direction while suppressing the unwanted signals coming from other directions. Specifically, the beamformer 120 generates the filtered speech signal Bs by enhancing the reception of the current spectral representation (FFT-1) of the main audio signal au-1 from the desired speech source and suppressing the current spectral representations (FFT-2~FFT-Q) of the auxiliary audio signals (au-2~au-Q) coming from other directions; besides, the beamformer 120 generates the filtered noise signal Bn by suppressing the current spectral representation (FFT-1) of the main audio signal (i.e., speech) au-1 coming from the desired speech source and enhancing the current spectral representations (FFT-2~FFT-Q) of the auxiliary audio signals (i.e., noise) (au-2~au-Q) coming from other directions. The beamformer 120 may be implemented using a variety of beamformers that are readily known to those of ordinary skill in the art. The beamformer 120 is used to suppress/eliminate the speech component in the filtered noise signal Bn and to prevent the filtered noise signal Bn from containing the speech component, thus avoiding the speech component from being eliminated in the operations of the ANC 130. Please note that the more the audio signals from the microphones are fed to the beamformer 120, the greater the SNR values of the beamformer 120 are and the greater the performance of the beamformer 120 gains.

Since the structure and the operations of the ANC 130 are well known in the art, their detailed descriptions are omitted herein. According to a control signal C2, the primary input of the ANC 130 receives the filtered speech signal Bs that is corrupted by the presence of noise no and the reference input of the ANC 130 receives the filtered noise signal Bn correlated in some way with noise no. Then, the adaptive filter (not shown) in the ANC 130 adaptively performs filtering operation over the filtered noise signal Bn to obtain a noise estimate. Afterward, the ANC 130 subtracts the noise estimate from the filtered speech signal Bs to obtain a signal estimate NC. As set forth above, the beamformer 120 generates the filtered noise signal Bn by suppressing the current spectral representation (FFT-1) of the main audio signal (i.e., speech) au-1 coming from the desired speech source. Thus, the filtered noise signal Bn received by the ANC 130 is relatively uncorrelated with the filtered speech signal Bs, thus avoiding self-cancellation of the speech component. Accordingly, the possibility of the damage to the speech component in the filtered speech signal Bs is reduced and the SNR of the main audio signal (i.e., speech) au-1 is improved in the ANC 130.

Figure 2A:
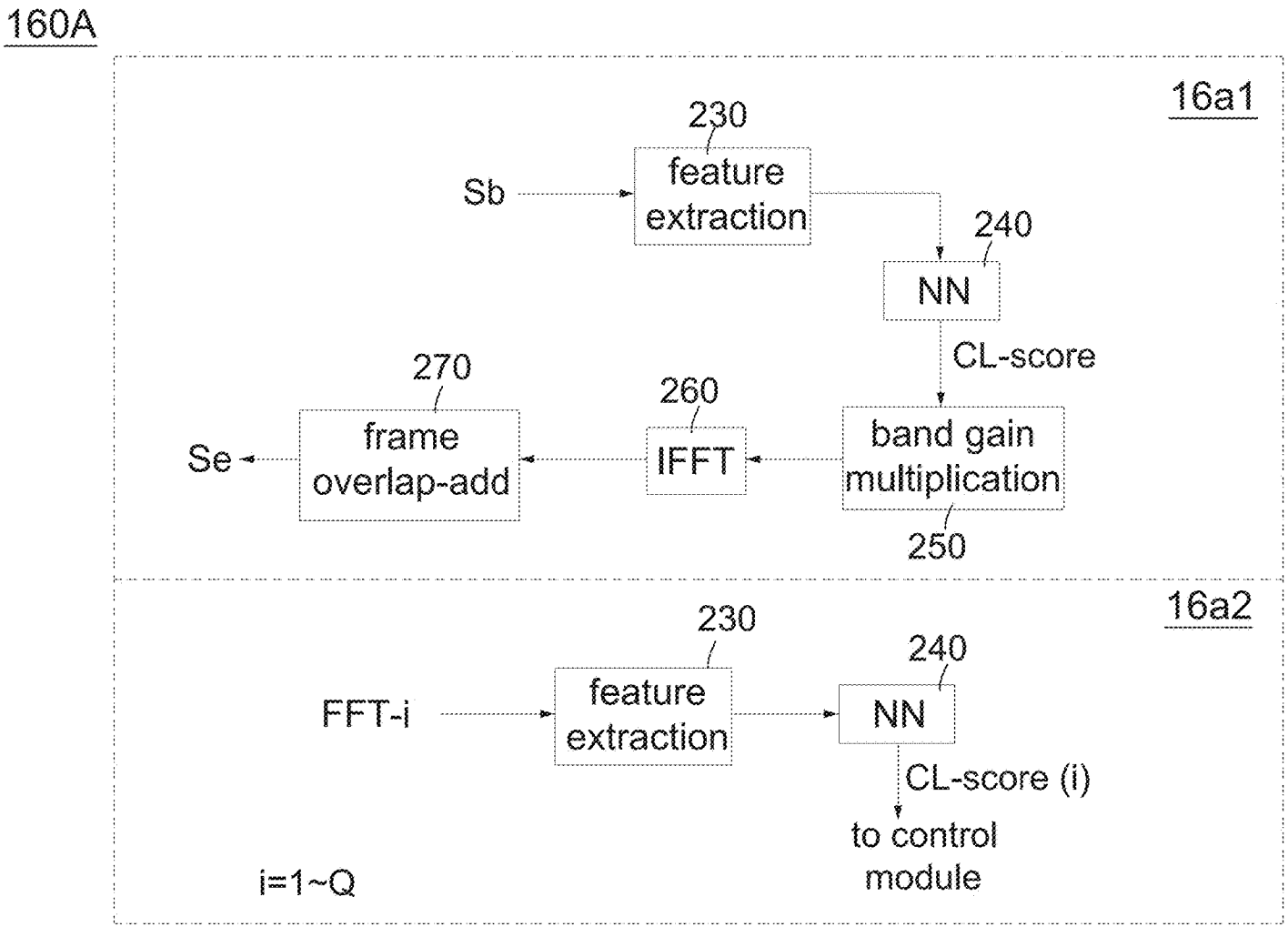
FIGS. 2A and 2B are block diagrams respectively showing a neural network-based noise suppressor and an exemplary neural network.
Figure 2B:
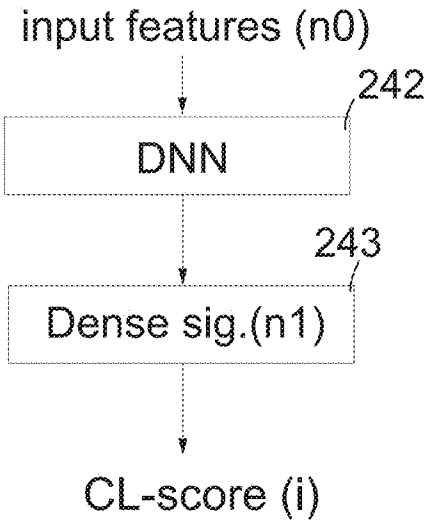

The noise suppressor 160 may be implemented using a neural network-based noise suppressor 160A. FIGS. 2A and 2B are block diagrams respectively showing a neural network-based noise suppressor and an exemplary neural network. The neural network-based noise suppressor 160A is modified based on the disclosure by Jean-Marc Valin, "A Hybrid DSP/Deep Learning Approach to Real-Time Full-Band Speech Enhancement", 2018 IEEE 20$^{th}$ International Workshop on Multimedia Signal processing (MMSP). Referring to FIG. 2A, the neural network-based noise suppressor 160A includes a noise suppression section 16*a*1 and Q classifying sections 16*a*2. Each of the noise suppression section 16*a*1 and the Q classifying sections 16*a*2 includes a feature extraction block 230 and a neural network (NN) 240. The noise suppression section 16*a*1 additionally includes a band gain multiplication block 250, a frame overlap-add block 270 and an inverse Fast Fourier Transform (IFFT) block 260. The feature extraction block 230 extracts features from the complex data in frequency domain for FFT-i/Sb, for example, transforming the FFT output into log spectrum. The neural network 240 estimates a series of frequency band gains being bounded between 0 and 1 for the current frame. The band gain multiplication block 250 multiplies the following frames by the series of frequency band gains from the neural network 240. The IFFT block 260 is used to transform the complex data in frequency domain into audio data in time domain for each frame. Without using rectangular windows, the frame overlap-add block 270 is configured to smooth elements of each frame by overlapping neighboring frames to make amplitudes of the elements more consistent to produce an enhanced signal Se in time domain so that perception of voice discontinuity is avoided after noise reduction.

The noise suppression section 16*a*1 combines digital signal processing (DSP)-based techniques with deep learning techniques. Specifically, the noise suppression section 16*a*1 is configured to suppress noise from its input audio signal Sb using the classification results of the neural network 240 to generate an enhanced signal Se in time domain. Please note that the classifying section 16*a*2 in FIG. 2A is provided for one of the Q current spectral representations (FFT-1~FFT-Q). For the example in FIG. 1, there are Q current spectral representations (FFT-1~FFT-Q) fed to the neural network-based noise suppressor 160A, so there would be, in fact, Q classifying sections 16*a*2 (not shown) included in the neural network-based noise suppressor 160A.

In each classifying section 16*a*2, the feature extraction 230 extracts features from the complex data in frequency domain for FFT-i and then the neural network 240 estimates a series of frequency band gains (i.e., its classification result CL-score (i)) being bounded between 0 and 1, for i=1~Q. Here, the frequency spectrum for the classification result CL-score (i) is divided into k frequency bands with a frequency resolution of fs/k. Please note that "the series of frequency band gains" can also be regarded as "the series of frequency band scores/prediction values". Thus, if any band gain value (i.e. a score) in CL-score (i) gets close to 0, it indicates the signal on the corresponding frequency band is noise-dominant; if any band gain value in CL-score (i) gets close to 1, it indicates the signal on the corresponding frequency band is speech-dominant. As will be detailed in descriptions related to FIGS. 3A and 3B, the classification results (i.e., CL-score (i)) of the neural network 240 greatly assist the control module 110 in determining which input audio signal is noise-dominant or speech-dominant.

The neural networks 240 includes a deep neural network (DNN) 242 and a fully-connected (dense) layers 243. The deep neural network 242 may be a recurrent neural network (RNN) (comprising vanilla RNN, gated recurrent units (GRU) and long short term memory (LSTM) network), a convolutional neural network (CNN), a temporal convolutional neural network, a fully-connected neural network or any combination thereof. The DNN 242 is used to receive audio feature vectors and encode temporal patterns and the fully-connected (dense) layers 243 are used to transform composite features from the feature extraction 230 into gains, i.e., CL-score (i). Since the ground truth for the gains requires both the noisy speech and the clean speech, the training data are constructed artificially by adding noise to clean speech data. For speech data, a wide range of people's speech is collected, such as people of different genders, different ages, different races and different language families. For noise data, various sources of noise are used, including markets, computer fans, crowd, car, airplane, construction, etc. For special purpose products, corresponding special-type noise are collected to improve noise-suppressing capability of the neural network-based noise suppressor 160A. For example, for video game products, keyboard typing noise needs to be included. The keyboard typing noise is mixed at different levels to produce a wide range of SNRs, including clean speech and noise-only segments. In a training phase, each neural network 240 is trained with multiple labeled training data sets, each labeled as belonging to one of two categories (speech-dominant or noise-dominant). When trained, each trained neural network 240 can process new unlabeled audio data, for example audio feature vectors, to generate corresponding scores/gains, indicating which category (noise-dominant or speech-dominant) the new unlabeled audio data most closely matches.

Figure 2C:
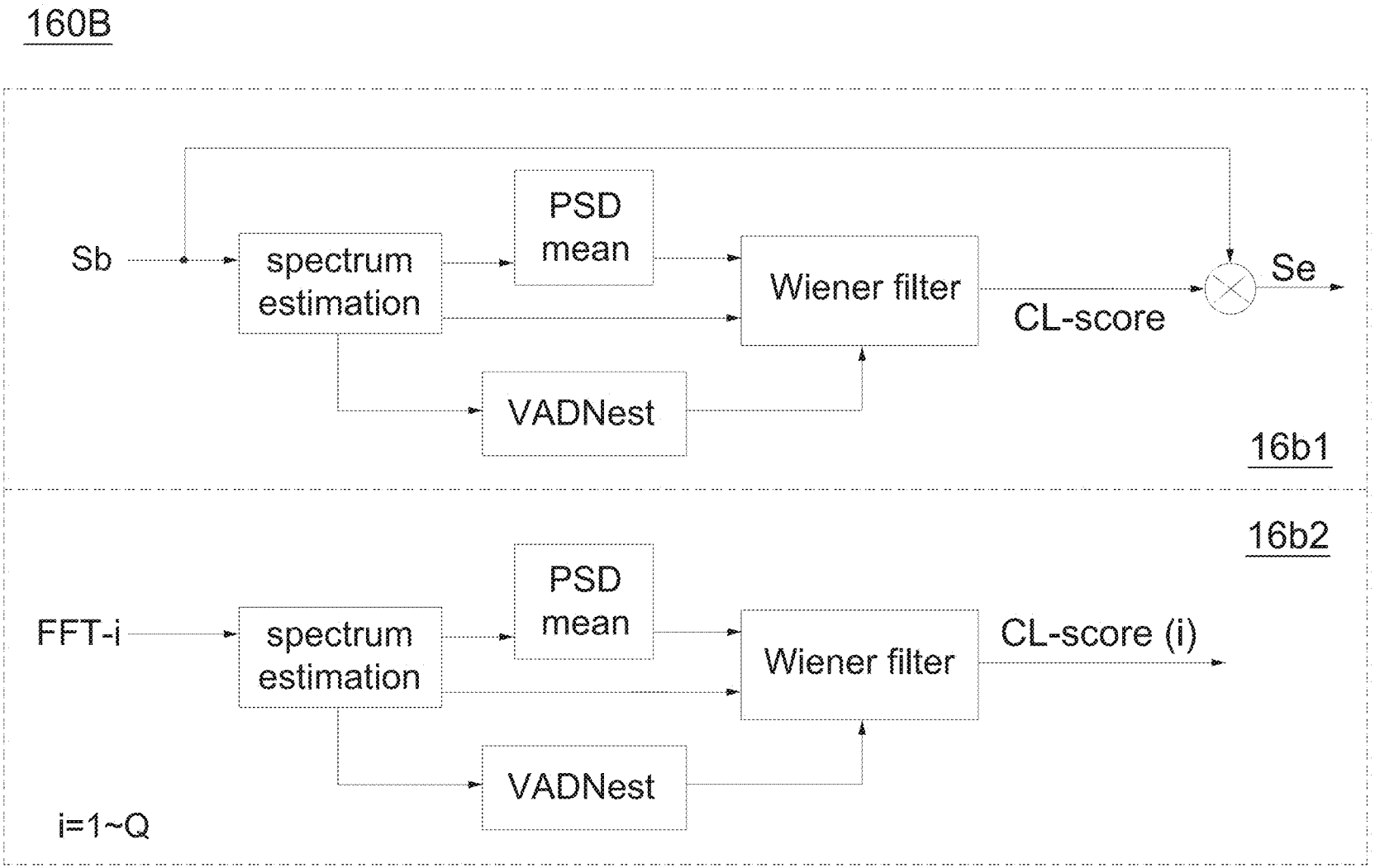
FIGS. 2C-2E are block diagrams respectively showing a noise suppressor with wiener filter, a noise suppressor with least mean square (LMS) adaptive filter and a noise suppressor using spectral subtraction.
Figure 2D:
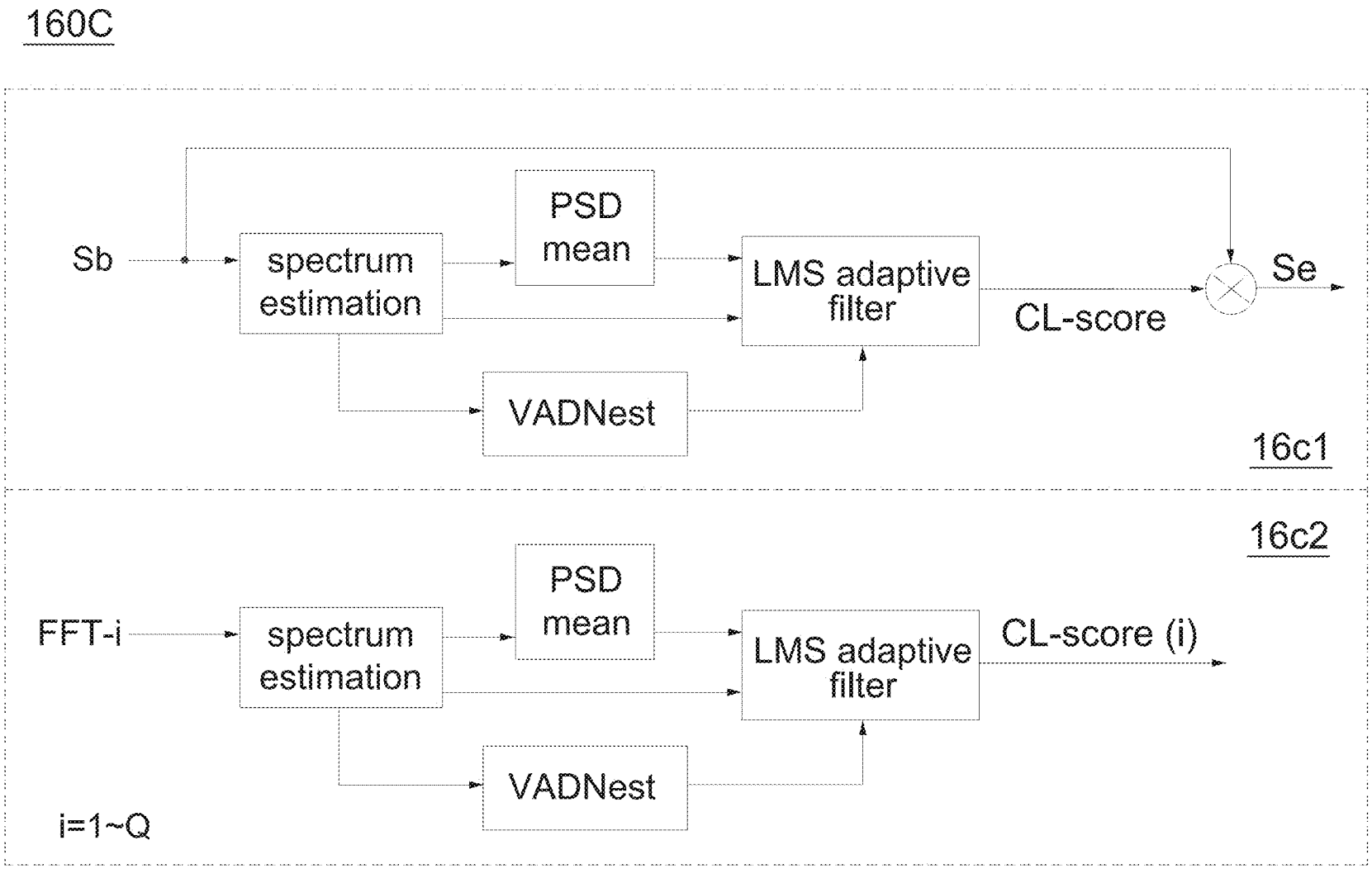
Figure 2E:
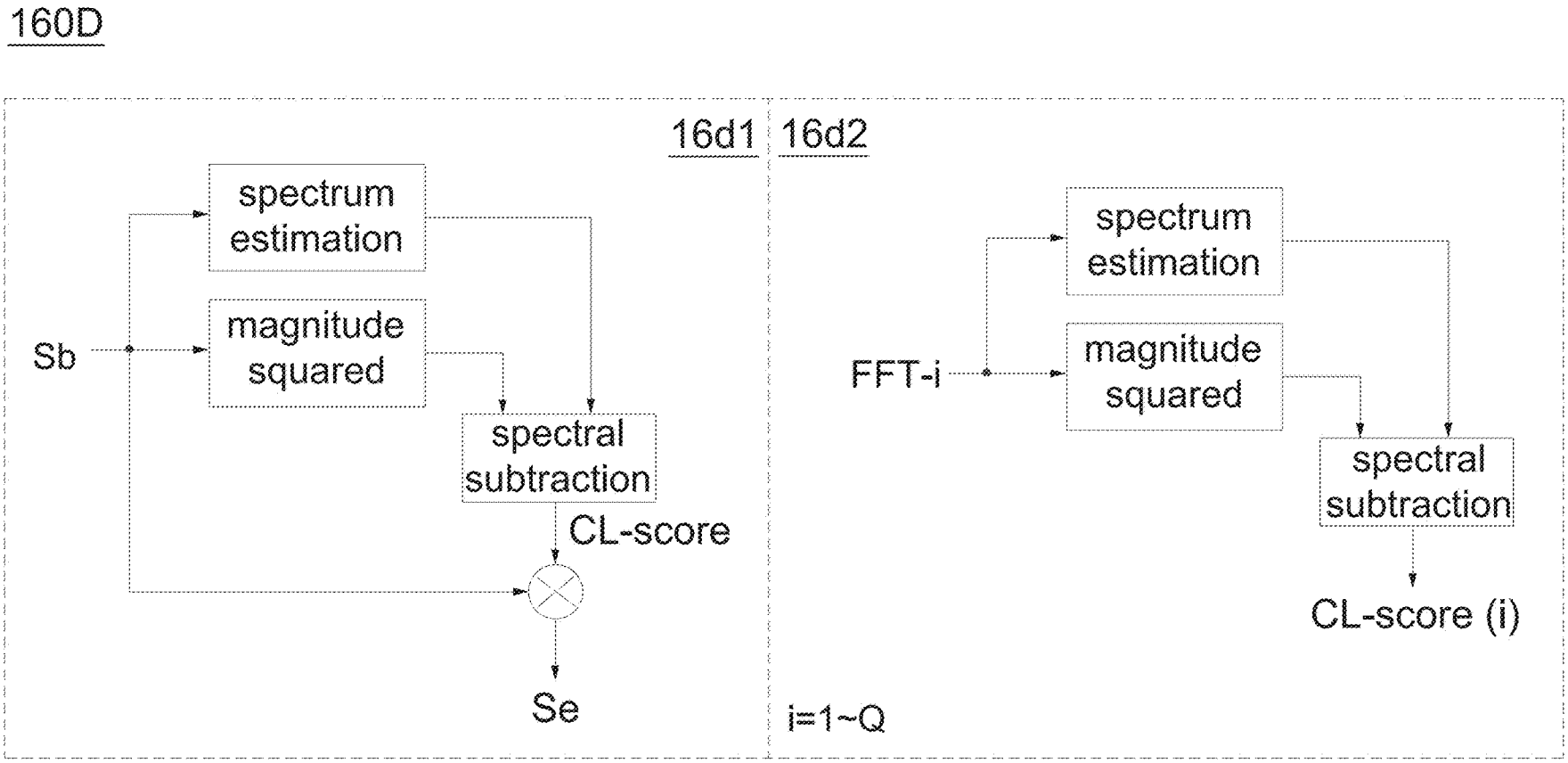

In addition to the neural network-based noise suppressor 160A, the noise suppressor 160 may be implemented using a noise suppressor with wiener filter (e.g., 160B in FIG. 2C), a noise suppressor with least mean square (LMS) adaptive filter (160C in FIG. 2D) or a noise suppressor using spectral subtraction (e.g., 160D in FIG. 2E). It should be understood that the invention is not limited to these particular few types of noise suppressors described above, but fully extensible to any existing or yet-to-be developed noise suppressor as long as the noise suppressor is able to generate Q classification results (CL-score (1) CL-score (Q)) according to the Q current spectral representations (FFT-1~FFT-Q).

Similar to the neural network-based noise suppressor 160A in FIG. 2A, a noise suppressor with wiener filter 160B includes a noise suppression section 16*b*1 and Q classifying sections 16*b*2 as shown in FIG. 2C, a noise suppressor with LMS adaptive filter 160C includes a noise suppression section 16*c*1 and Q classifying sections 16*c*2 as shown in FIG. 2D, and a noise suppressor using spectral subtraction 160D includes a noise suppression section 16*d*1 and Q classifying sections 16*d*2 as shown in FIG. 2E. Each of the noise suppression sections 16*b*1, 16*c*1 and 16*d*1 is configured to suppress noise from its input audio signal Sb using its classification results CL-score to generate an enhanced signal Se in time domain. A set of Q classifying sections (16*b*2/16*c*2/16*d*2) process the Q current spectral representations (FFT-1~FFT-Q) to generate Q classification results (CL-scores (1)~(Q)). Since the operations and structures of the noise suppressor with wiener filter 160B, the noise suppressor with LMS adaptive filter 160C and the noise suppressor using spectral subtraction 160D are well known in the art, their descriptions are omitted herein.

Figure 3A:
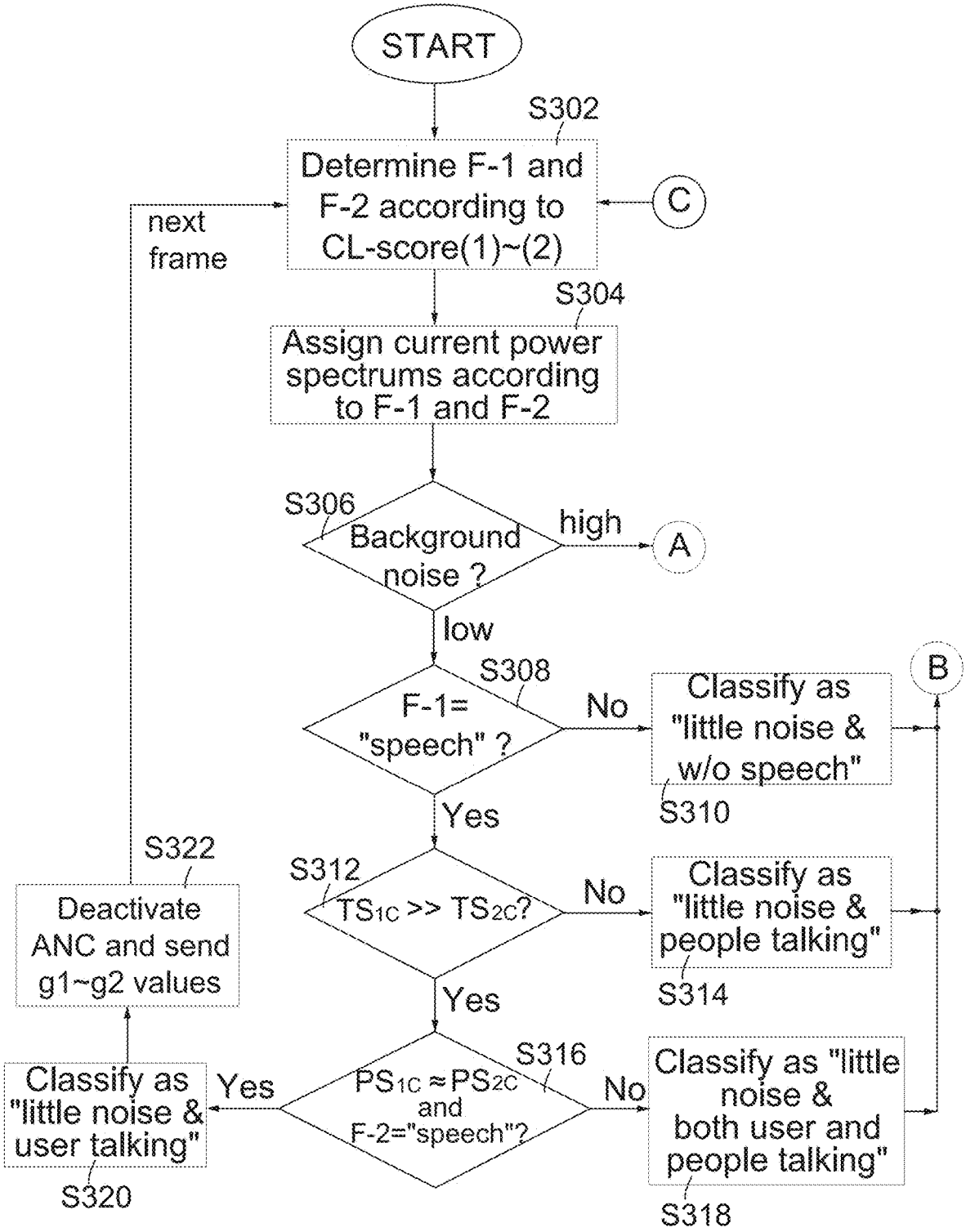
FIGS. 3A and 3B show a flow chart illustrating operations of a control module according to an embodiment of the invention.
Figure 3B:
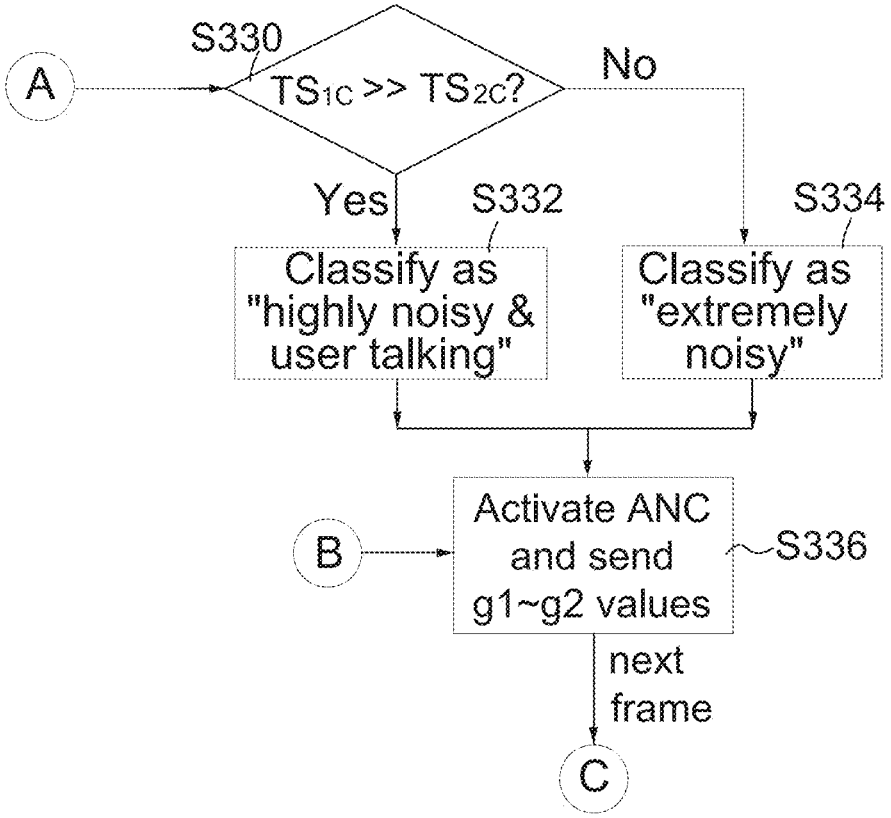

Please note that although the control module 110 receives a number Q of the current spectral representations (FFT-1~FFT-Q) and a number Q of classification results (CL-scores (1)~(Q)), the control module 110 merely needs two current spectral representations along with their corresponding classification results for operation. One of the two current spectral representations is derived from the main audio signal au-1 and the other is associated with a signal arbitrarily selected from the (Q−1) auxiliary audio signals (au-2~au-Q). FIGS. 3A and 3B show a flow chart illustrating operations of a control module according to an embodiment of the invention. For purposes of clarity and ease of description, the operations of the control module 110 are described with the assumption that two current spectral representations (FFT-1 and FFT-2) and their corresponding classification results (CL-scores (1) and (2)) are selected for operation and with reference to FIGS. 1, 2A and 3A-3B.

Step S302: Respectively determine Flags F-1 and F-2 for the current frames of the audio signals au-1 and au-2 according to classification results (CL-scores (1)~(2)) and four threshold values TH1~TH4. Assume that a first threshold value TH1=0.7, a second threshold value TH2=½, a third threshold value TH3=0.3, a fourth threshold value TH4=⅓, and N1=8. Given the CL-score (1)=[0.7, 0.9, 1.0, 0.9, 0.8, 1.0, 0.7, 0.6], since m1/N1>TH2(=½) and m2/N1<TH4(=⅓), it indicates the current frame of the audio signal au-1 is a speech-dominant signal and then the flag F-1 is set to 1 (indicating speech). Here, m1 denotes the number of elements greater than TH1 in the CL-score (i) and m2 denotes the number of elements less than TH3 in the CL-score (i), for i=1~2. Given the CL-score (2)=[0, 0.2, 0.1, 0, 0.3, 0.2, 0.6, 0.5], since m1/N1<TH2(=½) and m2/N1>TH4(=⅓), it indicates the current frame of the audio signal au-2 is a noise-dominant signal and then the flag F-2 is set to 0 (indicating noise). Please note that the values of the threshold values TH1~TH4 are provided by example and not limitations of the invention. In actual implementations, any other values for the threshold values TH1~TH4 may be used to accommodate design variations.

Step S304: Assign the current power spectrum of the current frame of the audio signal au-1 to one of a current noise power spectrum and a current speech power spectrum of the current frame of the audio signal au-1 according to the flag F-1 and assign the current power spectrum of the current frame of the audio signal au-2 to one of a current noise power spectrum and a current speech power spectrum of the current frame of the audio signal au-2 according to the flag F-2. According to the two current spectral representations (FFT-1 and FFT-2), the control module 110 computes the power level of each complex-valued sample on each frequency bin to obtain a current power spectrum for the current frame of each of the audio signal au-i, for i=1~2. Here, the control module 110 computes the power level of each complex-valued sample x on each frequency bin according to the equation: $\sqrt{(x_r^2+x_i^2)}$, where $x_r$ denotes a real part and $x_i$ denotes an imaginary part. Depending on the F-i value, the control module 110 assigns the current power spectrum to one of a current noise power spectrum and a current speech power spectrum for the current frame of the audio signal au-i. For example, the control module 110 assigns the obtained current power spectrum to a current speech power spectrum $PS_{1C}$ for the current frame of the audio signal au-1 due to the flag F-1 equal to 1 (indicating speech) and assigns the obtained current power spectrum to a current noise power spectrum $PN_{2C}$ for the current frame of the audio signal au-2 due to the flag F-2 equal to 0 (indicating noise). For another example, if the flags F-1 and F-2 are set to 1, the control module 110 instead assigns the obtained current power spectrums to the current speech power spectrums $PS_{1C}$ and $PS_{2C}$ for the current frames of the audio signals au-1 and au-2.

Step S306: Compare a total power value $TN_2$ of the average noise power spectrum $APN_2$ and a threshold TH5 to determine the power level of the background noise. If $TN_2$<TH5, it indicates the background noise is at a low power level, otherwise, the background noise is at a high power level. If the background noise is at a low power level, the flow goes to Step S308; otherwise, the flow goes to Step S330. In one embodiment, the following infinite impulse response (IIR) equations are provided to obtain an average noise power spectrum $APN_2$ and an average speech power spectrum $APS_2$ for the audio signal au-2:

$$APN_2=((1-a)*PN_{2C}+a*APN_2); \quad (1)$$

$$APS_2=((1-a)*PS_{2C}+a*APS_2); \quad (2)$$

where $PS_{2C}$ and $PN_{2C}$ respectively denote a current speech power spectrum and a current noise power spectrum for the current frame of the audio signal au-2.

In an alternative embodiment, the following sum-and-divide (SD) equations are provided to obtain an average noise power spectrum $APN_2$ and an average speech power spectrum $APS_2$ for the audio signal au-2:

$$APN_2=(PN_{2C}+PN_{2f1}+\ldots+PN_{2fg})/(1+g); \quad (3)$$

$$APS_2=(PS_{2C}+PS_{2f1}+\ldots+PS_{2fg})/(1+g); \quad (4)$$

where $PN_{2f1}$~$PN_{2fg}$ are previous noise power spectrums for g frames immediately previous to the current frame of the audio signal au-2 and $PS_{2f1}$~$PS_{2fg}$ are previous speech power spectrums for g frames immediately previous to the current frame of the audio signal au-2. The control module 110 calculates the sum of the power levels on the frequency bins of the average noise power spectrum $APN_2$ to produce a total power value $TN_2$. Besides, the control module 110 calculates the sum of the power levels on the frequency bins of the average speech power spectrum $APS_2$ to produce a total power value $TS_2$, and multiplies the power value $TS_2$ by a weight C to obtain a threshold value TH5, i.e., TH5=$TS_2$*C. In a preferred embodiment, the weight C ranges from 4 to 8. It is important to compare the total power value $TN_2$ of the average noise power spectrum $APN_2$ and the total power value $TS_2$ of the average noise power spectrum $APS_2$. If $TN_2$ is not large enough compared to $TS_2$, it is not appropriate to activate the ANC 130.

Step S308: Determine whether the flag F-1 is equal to 1 (indicating speech). If YES, the flow goes to Step S312; otherwise, the flow goes to Step S310.

Step S310: Classify the ambient environment as scenario B (a little noisy environment without speech). The current noise power spectrum $PN_{1C}$ is used to update the average noise power spectrum $APN_1$ and the current noise power spectrum $PN_{2C}$ is used to update the average noise power spectrum $APN_2$ according to the above IIR or SD equations.

Step S312: Determine whether a total power value $TS_{1C}$ of the current speech power spectrum $PS_{1C}$ for the current frame of the signal au-1 is much greater than a total power value $TS_{2C}$ of the current speech power spectrum $PS_{2C}$ for the current frame of the signal au-2. If YES, it indicates the user is speaking and the flow goes to Step S316; otherwise, it indicates the user is not speaking and the flow goes to Step S314. The control module 110 calculates the sum of the power levels on the frequency bins of the current speech power spectrum $PS_{1C}$ to produce a total power value $TS_{1C}$, and calculates the sum of the power levels on the frequency bins of the current speech power spectrum $PS_{2C}$ to produce a total power value $TS_{2C}$. In a preferred embodiment, determine whether the total power value $TS_{1C}$ is 6 dB greater than the total power value $TS_{2C}$. However, the difference of 6 dB is provided by example and not limitation of the invention. In actual implementations, the difference that the power value $TS_{1C}$ needs to be greater than the power value $TS_{2C}$ is adjustable and depends on the actual locations and the sensitivity of the microphones MIC-1 and MIC-2.

Step S314: Classify the ambient environment as scenario C (a little noisy environment with several people talking). In scenario C, the user is not speaking, but his neighboring person(s) is speaking at a low volume; his neighboring person(s)' speech is regarded as noise. Thus, the speech power spectrum $PS_{1C}$ is used to update the average speech power spectrum $APS_1$ and the current speech power spectrum $PS_{2C}$ is used to update the average noise power spectrum $APN_2$ according to the above IIR or SD equations.

Step S316: Determine whether the current speech power spectrum $PS_{1C}$ is similar to the current speech power spectrum $PS_{2C}$ and the flag F-2 is equal to 1. If YES, the flow goes to Step S320; otherwise, the flow goes to Step S318. In an embodiment, the control module 110 calculates (a) the sum of absolute differences (SAD) between the power levels of the frequency bins of the two current speech power spectrums $PS_{1C}$~$PS_{2C}$ to produce a first sum $DS_{12}$, (b) the sum of absolute differences between the gains of the frequency bands of the CL-scores (1) and (2) to produce a second sum $DAI_{12}$, and (c) the coherence $Coh_{12}$ between the two speech power spectrums $PS_{1C}$~$PS_{2C}$ according to the following magnitude-squared coherence equation:

$$Coh_{12}(f) = \frac{|P_{12}(f)|^2}{PS_{1C}(f)PS_{2C}(f)},$$

where $P_{12}$ is the cross-power spectral density of audio signals au-1 and au-2. The magnitude of the coherence is limited to the range (0,1) and a measure of amplitude coupling between two FFTs at a certain frequency f. If both of the first and the second sums $DAI_{12}$ and $DS_{12}$ are less than 6 dB and the $Coh_{12}$ value is close to 1, the control module 110 determines that the two speech power spectrums $PS_{1C}$~$PS_{2C}$ are similar, otherwise, the control module 110 determines that they are different.

Step S318: Classify the ambient environment as scenario D (a little noisy environment with both the user and people talking). In scenario D, both the user and his neighboring person(s) are speaking. Because the current speech power spectrum $PS_{1C}$ is different from the current speech power spectrum $PS_{2C}$, the speech component contained in the audio signal au-2 is in fact a noise. Thus, the current speech power spectrum $PS_{1C}$ is used to update the average speech power spectrum $APS_1$ and the current speech power spectrum $PS_{2C}$ is used to update the average noise power spectrum $APN_2$ according to the above IIR or SD equations.

Step S320: Classify the ambient environment as scenario A (a little noisy environment with the user talking). In scenario A, since the user is speaking in a little noisy environment, there is a strong possibility that the speech component leaks into the audio signal au-2, and then the operations of the ANC 130 are very likely to damage the speech component in the filtered speech signal Bs. Thus, the ANC 130 needs to be disabled to prevent self-cancellation of the user's speech. Since the two flags F-1 and F-2 are equal to 1, the current speech power spectrum $PS_{1C}$ is used to update the average speech power spectrum $APS_1$ and the current speech power spectrum $PS_{2C}$ is used to update the average speech power spectrum $APS_2$ according to the above IIR or SD equations.

Figure 4:
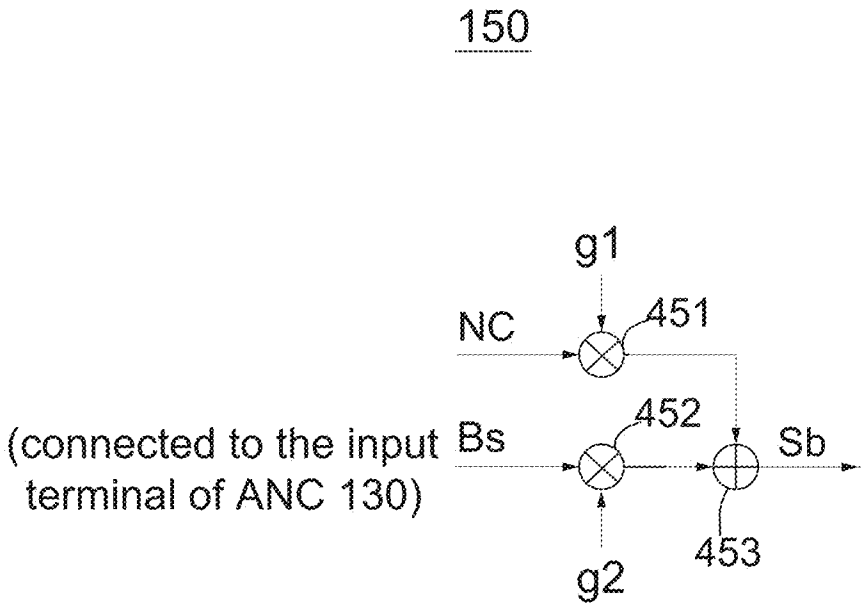
FIG. 4 is a block diagram of a blending unit according to an embodiment of the invention.

Step S322: De-activate the ANC 130. Specifically, the control module 110 asserts the control signal C1 to activate the beamformer 120, de-asserts the control signal C2 to de-activate the ANC 130 and transmits the gain value g1 of 0 and the gain value g2 of 1 to the blending unit 150. Afterward, the flow goes back to step S302 for the next frame. Referring to FIG. 4, the blending unit 150 includes two multipliers 451~452 and an adder 453. The multiplier 451 multiplies the signal estimate NC by the gain value g1 of 0 and the multiplier 452 multiplies the filtered speech signal Bs by the gain value g2 of 1. Finally, the adder 453 adds two outputs of two multipliers 451~452 to output the blended signal Sb.

Step S330: Determine whether a total power value $TS_{1C}$ of the current speech power spectrum $PS_{1C}$ for the current frame of the signal au-1 is much greater than a total power value $TS_{2C}$ of the current speech power spectrum $PS_{2C}$ for the current frame of the signal au-2. If YES, it indicates the user is speaking and the flow goes to Step S332; otherwise, it indicates the user is not speaking and the flow goes to Step S334. In a preferred embodiment, determine whether the power value $TS_{1C}$ is 6 dB greater than the power value $TS_{2C}$. However, the difference of 6 dB is provided by example and not limitation of the invention. In actual implementations, the difference that the power value $TS_{1C}$ needs to be greater than the power value $TS_{2C}$ is adjustable and depends on the actual locations and the sensitivity of the microphones MIC-1 and MIC-2.

Step S332: Classify the ambient environment as scenario E (a highly noisy environment with the user talking). Scenario E indicates the background noise is at a high power level and the user is speaking. The current speech power spectrum $PS_{1C}$ is used to update the average speech power spectrum $APS_1$ and the current noise power spectrum $PN_{2C}$ is used to update the average noise power spectrum $APN_2$ using the above IIR or SD equations.

Step S334: Classify the ambient environment as scenario F (a extremely noisy environment). Scenario F represents two following conditions: condition 1: the background noise is at a high power level and the user is not speaking; condition 2: the background noise is extremely high enough to inundate the user's speech. The current noise power spectrum $PN_{1C}$ is used to update the average noise power spectrum $APN_1$ and the current noise power spectrum $PN_{2C}$ is used to update the average noise power spectrum $APN_2$ according to the above II R or SD equations.

Step S336: Activate the ANC 130. Specifically, the control module 110 asserts the control signal C1 to activate the beamformer 120, asserts the control signal C2 to activate the ANC 130 and transmits the gain value g1 of 1 and the gain value g2 of 0 to the blending unit 150. Afterward, the flow returns to step S302 for the next frame.

In summary, for little noisy environments including scenarios B-D (i.e., a little noisy environment without speech, a little noisy environment with several people talking and a little noisy environment with both the user and people talking), operations of the ANC 130 do not damage the speech component in the filtered speech signal Bs, and instead suppress more noise contained in the filtered speech signal Bs. For highly noisy environments including scenarios E-F (i.e., a highly noisy environment with the user talking, and an extremely noisy environment), since the noise filtered signal Bn mostly contains noise, operations of the ANC 130 are not likely to damage the speech component in the filtered speech signal Bs, and instead suppress more noise in the filtered speech signal Bs.

Please note that since the power levels of the two current noise power spectrums $PN_{1C}$~$PN_{2C}$ and the two current speech power spectrums $PS_{1C}$~$PS_{2C}$ for the current frames of the audio signals au-1 and au-2 are usually different under the same controlled conditions, the power levels of the two current noise power spectrums $PN_{1C}$~$PN_{2C}$ and the two current speech power spectrums $PS_{1C}$~$PS_{2C}$ need to be calibrated to the same levels during initialization (prior to the step 302). For example, during initialization, given $PS_{1C}$=[6, 6, 6, 6], $PS_{2C}$=[2, 2, 2, 3], $PN_{1C}$=[3, 3, 3, 2] and $PN_{2C}$=[1, 2, 2, 6], the control module 110 would automatically multiply $PS_{2C}$ by a gain array $g_{2s}$=[3, 3, 3, 2], multiply $PN_{1C}$ by a gain array $g_{1N}$=[2, 2, 2, 3] and multiply $PN_{2C}$ by a gain array $g_{2N}$=[6, 3, 3, 1] for the subsequent calculations; after calibration, the power levels of $PN_{1C}$~$PN_{2C}$ and $PS_{1C}$~$PS_{2C}$ are all calibrated to the same level, e.g., [6, 6, 6, 6]. Other methods of calibrating the power levels of the power spectrums for frames of audio signals au-1 and au-2 may alternatively be used.

In an alternative embodiment, the process that sets the gain values g1 and g2 to their current values is divided into multiple steps within a predefined interval (called "multiple-step setting process") by the control module 110 if the previous and the current values of g1 and g2 are different; contrarily, if the previous and the current values of g1 and g2 are the same, g1 and g2 remain unchanged. For example, assume that g1 and g2 have previous values of 1 and 0 and current values of 0 and 1. Since the previous and the current values of g1 and g2 are different, the whole setting process is divided into three steps within 1 ms as follows. The gain values g1 and g2 are first set to 0.7 and 0.3 at first step (within the first 0.3 ms), then set to 0.4 and 0.6 at second step (within the second 0.3 ms), and finally set to 0 and 1 (current values) at third step (within 0.4 ms). The multiple-step setting process helps smooth transition for the blended signal Sb, which improves audio quality.

Figure 5:
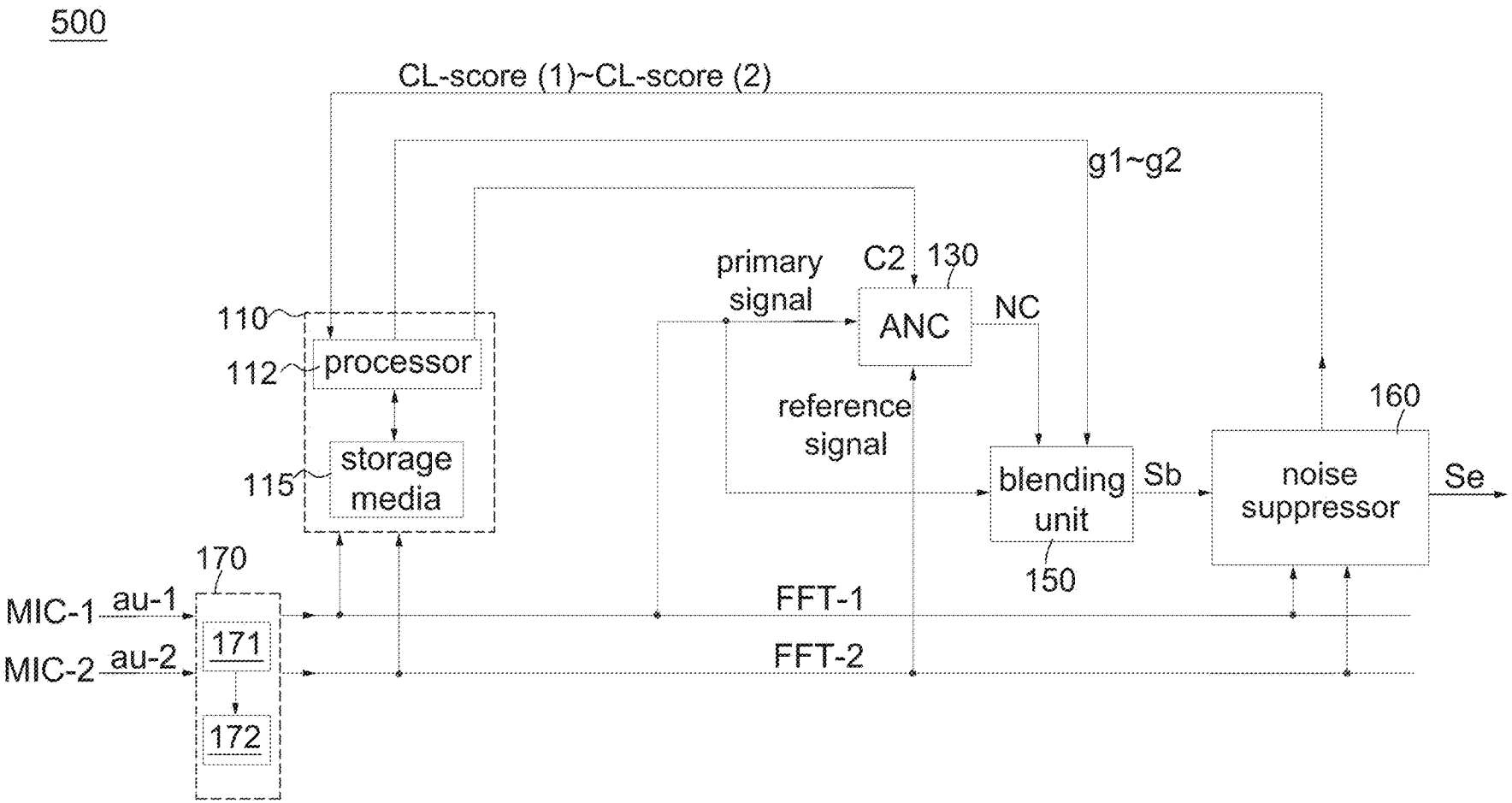
FIG. 5 is a schematic diagram showing a two-microphone speech enhancement apparatus according to another embodiment of the invention.

FIG. 5 is a schematic diagram showing a two-microphone speech enhancement apparatus according to another embodiment of the invention. Referring to FIG. 5, a two-microphone speech enhancement apparatus 500 of the invention includes a control module 110, an adaptive noise canceller (ANC) 130, a blending unit 150, a noise suppressor 160 and a pre-processing circuit 170. In comparison to FIG. 1, the beamformer 120 is excluded and only two microphones (MIC-1 & MIC-2) are included in the two-microphone speech enhancement apparatus 500 of FIG. 5. Although the two-microphone speech enhancement apparatus 500 operates well, its performance would improve if the two-microphone speech enhancement apparatus 500 further includes the beamformer 120. If the beamformer 120 is included in the two-microphone speech enhancement apparatus 500, the SNR value for the filtered speech signal Bs outputted from the beamformer 120 would be raised; besides, it is very likely that the threshold value TH5 (referring back to the description of step S306 in FIG. 3A) can be reduced because the speech component contained in the filtered noise signal Bn outputted from the beamformer 120 is reduced. Accordingly, the ANC 130 would be activated in a less-noisy condition.

The multiple-microphone speech enhancement apparatus 100/500 according to the invention may be hardware, software, or a combination of hardware and software (or firmware). An example of a pure solution would be a field programmable gate array (FPGA) design or an application specific integrated circuit (ASIC) design. In a preferred embodiment, the multiple-microphone speech enhancement apparatus 100/500 are implemented with a general-purpose processor and a program memory. The program memory stores a processor-executable program. When the processor-executable program is executed by the general-purpose processor, the general-purpose processor is configured to function as: the control module 110, a beamformer 120, the ANC 130, the blending unit 150, the noise suppressor 160 and the pre-processing circuit 170.

The above embodiments and functional operations can be implemented in digital electronic circuitry, in tangibly-embodied computer software or firmware, in computer hardware, including the structures disclosed in this specification and their structural equivalents, or in combinations of one or more of them. The methods and logic flows described in FIGS. 3A-3B can be performed by one or more programmable computers executing one or more computer programs to perform their functions. The methods and logic flows in FIGS. 3A-3B can also be performed by, and the multiple-microphone speech enhancement apparatus 100 can also be implemented as, special purpose logic circuitry, e.g., an FPGA (field programmable gate array) or an ASIC (application-specific integrated circuit). Computers suitable for the execution of the one or more computer programs include, by way of example, can be based on general or special purpose microprocessors or both, or any other kind of central processing unit. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks.

While certain exemplary embodiments have been described and shown in the accompanying drawings, it is to be understood that such embodiments are merely illustrative of and not restrictive on the broad invention, and that this invention should not be limited to the specific construction and arrangement shown and described, since various other modifications may occur to those ordinarily skilled in the art.

What is claimed is:

1. A speech enhancement apparatus, comprising:

an adaptive noise cancellation (ANC) circuit having a primary input and a reference input, wherein the ANC circuit filters a reference signal from the reference input to generate a noise estimate and subtracts the noise estimate from a primary signal from the primary input to generate a signal estimate in response to a control signal;

a blending circuit for blending the primary signal and the signal estimate to produce a blended signal according to a blending gain;

a noise suppressor configured to suppress noise from the blended signal using a noise suppression section to generate an enhanced signal and to respectively process a main spectral representation of a main audio signal from a main microphone and M auxiliary spectral representations of M auxiliary audio signals from M auxiliary microphones using (M+1) classifying sections to generate a main score and M auxiliary scores; and a control module configured to perform a set of operations comprising:

generating the blending gain and the control signal according to the main score, a selected auxiliary score, an average noise power spectrum of a selected auxiliary audio signal, and characteristics of current speech power spectrums of the main spectral representation and a selected auxiliary spectral representation;

wherein the selected auxiliary score and the selected auxiliary spectral representation correspond to the selected auxiliary audio signal out of the M auxiliary audio signals.

2. The apparatus according to claim 1, wherein M=1, and wherein the primary signal is the main spectral representation, and the reference signal is the auxiliary spectral representation.

3. The apparatus according to claim 1, further comprising:

a beamformer configured to enhance the main spectral representation and suppress the M auxiliary spectral representations to generate the primary signal, and configured to suppress the main spectral representation and enhance the M auxiliary spectral representations to generate the reference signal.

4. The apparatus according to claim 1, wherein each of the noise suppression section and the (M+1) classifying sections comprises a neural network configured to classify its input signals as either speech-dominant or noise-dominant.

5. The apparatus according to claim 1, wherein each of the main score and the M auxiliary scores comprises a series of frequency band scores, each indicating its corresponding frequency band is either speech-dominant or noise-dominant.

6. The apparatus according to claim 1, further comprising:

a converter for respectively converting current frames of the main audio signal and the M auxiliary audio signals in time domain into the main and the M auxiliary spectral representations.

7. The apparatus according to claim 1, wherein prior to the operation of generating, the set of operations further comprise:

respectively calculating a first current power spectrum and a second current power spectrum based on the main and the selected auxiliary spectral representations;

assigning the first current power spectrum to one of a current noise power spectrum and the current speech power spectrum of the main audio signal according to the main score; and assigning the second current power spectrum to one of a current noise power spectrum and the current speech power spectrum of the selected auxiliary audio signal according to the selected auxiliary score.

8. The apparatus according to claim 1, wherein the operation of generating the control signal comprises:

determining a power level of a background noise by comparing a first threshold value with a total power value of the average noise power spectrum of the selected auxiliary audio signal;

determining whether a user is speaking by comparing total power values of the current speech power spectrums of the main and the selected auxiliary spectral representations;

determining whether the current speech power spectrums of the main and the selected auxiliary spectral representations are similar by comparing differences between the current speech power spectrums of the main and the selected auxiliary spectral representations;

determining whether the main audio signal is speech-dominant according to data distribution of score values of a plurality of frequency bands contained in the main score;

determining whether the selected auxiliary audio signal is speech-dominant according to data distribution of score values of the plurality of frequency bands contained in the selected auxiliary score; and if the background noise is at a low power level, the user is speaking, the current speech power spectrums of the main and the selected auxiliary spectral representations are similar and both the main score and the selected auxiliary score indicate the main and the selected auxiliary audio signal are speech-dominant, de-asserting the control signal, otherwise, asserting the control signal.

9. The apparatus according to claim 8, wherein the operation of de-asserting the control signal comprises:

if the background noise is at a high power level and the user is speaking, classifying an ambient environment as "a highly noisy environment with the user talking" and asserting the control signal;

if the background noise is at the high power level and the user is not speaking, classifying the ambient environment as "an extremely noisy environment" and asserting the control signal;

if the background noise is at the low power level and the main score indicates the main audio signal is noise-dominant, classifying the ambient environment as "a little noisy environment without speech" and asserting the control signal;

if the background noise is at the low power level, the user is speaking, and the main score indicates the main audio signal is noise-dominant, classifying the ambient environment as "a little noisy environment with people talking" and asserting the control signal; and if the background noise is at the low power level, the user is speaking, the current speech power spectrums of the main and the selected auxiliary spectral representations are similar and both the main score and the selected auxiliary score indicate the main and the selected auxiliary audio signal are speech-dominant, classifying the ambient environment as "a little noisy environment with the user talking" and de-asserting the control signal, otherwise, classifying the ambient environment as "a little noisy environment with the user and people talking" and asserting the control signal.

10. The apparatus according to claim 8, wherein the operation of generating the blending gain comprises:

if the control signal is de-asserted and previous values and current values of a first gain and a second gain are different, setting the first gain to its current value of 1 for the primary signal and setting the second gain to its current value of 0 for the signal estimate using a multiple-step setting process within a predetermined interval; and if the control signal is asserted and the previous values and current values of the first gain and the second gain are different, setting the first gain to its current value of 0 for the primary signal and setting the second gain to its current value of 1 for the signal estimate using the multiple-step setting process within the predetermined interval, otherwise, keeping the first gain and the second gain unchanged;

wherein the blending gain comprises the first gain and the second gain.

11. The apparatus according to claim 8, wherein the operation of determining the power level of the background noise comprises:

comparing the total power value of the average noise power spectrum of the selected auxiliary audio signal with the first threshold value; and if the total power value of the average noise power spectrum of the selected auxiliary audio signal is less than the first threshold value, determining that the background noise is at the low power level, otherwise, determining that the background noise is at the high power level;

wherein the first threshold value is a multiple of a total power value of an average speech power spectrum of the selected auxiliary audio signal;

wherein the average noise power spectrum of the selected auxiliary audio signal is associated with an average of a current noise power spectrum of a current frame and previous noise power spectrums of a first predefined number of previous frames of the selected auxiliary audio signal; and wherein the average speech power spectrum of the selected auxiliary audio signal is associated with an average of a current speech power spectrum of a current frame and previous speech power spectrums of a second predefined number of previous frames of the selected auxiliary audio signal.

12. The apparatus according to claim 8, wherein the operation of determining whether the user is speaking comprises:

if the total power value of the current speech power spectrum of the main audio signal is greater than that of the selected auxiliary audio signal by a second threshold value, determining that the user is speaking, otherwise, determining that the user is not speaking.

13. The apparatus according to claim 8, wherein the operation of de-asserting the control signal further comprises:

calculating a first sum of absolute differences (SAD) between the power levels of frequency bins of the current speech power spectrums of the main and the selected auxiliary audio signals;

calculating a second sum of absolute differences between the score values of the frequency bands of the main and the selected auxiliary scores;

calculating a coherence value between the current speech power spectrums of the main and the selected auxiliary audio signals: and if the first SAD and the second SAD are less than a third threshold value and the coherence value is close to 1, determining that the current speech power spectrums of the main and the selected auxiliary audio signals are similar, otherwise, determining that the current speech power spectrums of the main and the selected auxiliary audio signals are different.

14. The apparatus according to claim 1, wherein distances between locations of the M auxiliary microphones and a user's mouth are Z times longer than a distance between locations of the main microphone and the user's mouth, and wherein Z>=2.

15. A speech enhancement method, comprising:

respectively processing a main spectral representation of a main audio signal from a main microphone and M auxiliary spectral representations of M auxiliary audio signals from M auxiliary microphones using (M+1) classifying processes to generate a main score and M auxiliary scores;

generating a blending gain and a control signal according to the main score, a selected auxiliary score, an average noise power spectrum of a selected auxiliary audio signal, and characteristics of current speech power spectrums of the main spectral representation and a selected auxiliary spectral representation, wherein the selected auxiliary score and the selected auxiliary spectral representation correspond to the selected auxiliary audio signal out of the M auxiliary audio signals;

controlling an adaptive noise cancellation process by the control signal for filtering a reference signal to generate a noise estimate and for subtracting the noise estimate from a primary signal to generate a signal estimate;

blending the primary signal and the signal estimate to produce a blended signal according to the blending gain; and suppressing noise from the blended signal using a noise suppression process to generate an enhanced signal.

16. The method according to claim 15, further comprising:

respectively converting current frames of the main audio signal and the M auxiliary audio signals in time domain into the main and the M auxiliary spectral representations before the step of respectively processing; and repeating the steps of respectively converting, respectively processing, generating, controlling, blending and suppressing the noise until all frames of the main audio signal and the selected auxiliary audio signals are processed.

17. The method according to claim 15, wherein M=1, and wherein the primary signal is the main spectral representation, and the reference signal is the auxiliary spectral representation.

18. The method according to claim 15, further comprising:

enhancing the main spectral representation and suppressing the M auxiliary spectral representations using a beamforming process to generate the primary signal; and suppressing the main spectral representation and enhancing the M auxiliary spectral representations using the beamforming process to generate the reference signal.

19. The method according to claim 15, wherein each of the main score and the M auxiliary scores comprises a series of frequency band scores, each indicating its corresponding frequency band is either speech-dominant or noise-dominant.

20. The method according to claim 15, further comprising:

respectively calculating a first current power spectrum and a second current power spectrum based on the main spectral representation and the selected auxiliary spectral representation prior to the step of generating;

assigning the first current power spectrum to one of a current noise power spectrum and the current speech power spectrum of the main audio signal according to the main score; and assigning the second current power spectrum to one of a current noise power spectrum and the current speech power spectrum of the selected auxiliary audio signal according to the selected auxiliary score.

21. The method according to claim 15, wherein the step of generating the control signal comprises:

determining a power level of a background noise by comparing a first threshold value with a total power value of the average noise power spectrum of the selected auxiliary audio signal;

determining whether a user is speaking by comparing total power values of the current speech power spectrums of the main and the selected auxiliary spectral representations;

determining whether the current speech power spectrums of the main and the selected auxiliary spectral representations are similar by comparing differences between the current speech power spectrums of the main and the selected auxiliary spectral representations;

determining whether the main audio signal is speech-dominant according to data distribution of score values of a plurality of frequency bands contained in the main score;

determining whether the selected auxiliary audio signal is speech-dominant according to data distribution of score values of the plurality of frequency bands contained in the selected auxiliary score; and if the background noise is at a low power level, the user is speaking, the current speech power spectrums of the main and the selected auxiliary spectral representations are similar and both the main score and the selected auxiliary score indicate the main and the selected auxiliary audio signal are speech-dominant, de-asserting the control signal, otherwise, asserting the control signal.

22. The method according to claim 21, wherein the step of de-asserting the control signal comprises:

if the background noise is at a high power level and the user is speaking, classifying an ambient environment as "a highly noisy environment with the user talking" and asserting the control signal;

if the background noise is at the high power level and the user is not speaking, classifying the ambient environment as "an extremely noisy environment" and asserting the control signal;

if the background noise is at the low power level and the main score indicates the main audio signal is noise-dominant, classifying the ambient environment as "a little noisy environment without speech" and asserting the control signal;

if the background noise is at the low power level, the user is speaking, and the main score indicates the main audio signal is noise-dominant, classifying the ambient environment as "a little noisy environment with people talking" and asserting the control signal; and if the background noise is at the low power level, the user is speaking, the current speech power spectrums of the main and the selected auxiliary spectral representations are similar and both the main score and the selected auxiliary score indicate the main and the selected auxiliary audio signal are speech-dominant, classifying the ambient environment as "a little noisy environment with the user talking" and de-asserting the control signal, otherwise, classifying the ambient environment as "a little noisy environment with the user and people talking" and asserting the control signal.

23. The method according to claim 21, wherein the step of generating the blending gain comprises:

if the control signal is de-asserted and previous values and current values of a first gain and a second gain are different, setting the first gain to its current value of 1 for the primary signal and setting the second gain to its current value of 0 for the signal estimate using a multiple-step setting process within a predetermined interval; and if the control signal is asserted and the previous values and current values of the first gain and the second gain are different, setting the first gain to its current value of 0 for the primary signal and setting the second gain to its current value of 1 for by the signal estimate using the multiple-step setting process within the predetermined interval, otherwise, keeping the first gain and the second gain unchanged;

wherein the blending gain comprises the first gain and the second gain.

24. The method according to claim 21, wherein the step of determining the power level of the background noise comprises:

comparing the total power value of the average noise power spectrum of the selected auxiliary audio signal with the first threshold value; and if the total power value of the average noise power spectrum of the selected auxiliary audio signal is less than the first threshold value, determining that the background noise is at the low power level, otherwise, determining that the background noise is at a high power level;

wherein the first threshold value is a multiple of a total power value of an average speech power spectrum of the selected auxiliary audio signal;

wherein the average noise power spectrum of the selected auxiliary audio signal is associated with an average of a current noise power spectrum of a current frame and previous noise power spectrums of a first predefined number of previous frames of the selected auxiliary audio signal; and wherein the average speech power spectrum of the selected auxiliary audio signal is associated with an average of a current speech power spectrum of a current frame and previous speech power spectrums of a second predefined number of previous frames of the selected auxiliary audio signal.

25. The method according to claim 21, wherein the step of determining whether the user is speaking comprises:

if the total power value of the current speech power spectrum of the main audio signal is greater than that of the selected auxiliary audio signal by a second threshold value, determining that the user is speaking, otherwise, determining that the user is not speaking.

26. The method according to claim 21, wherein the step of de-asserting the control signal comprises:

calculating a first sum of absolute differences (SAD) between the power levels of frequency bins of the current speech power spectrums of the main and the selected auxiliary audio signals;

calculating a second sum of absolute differences between the score values of the frequency bands of the main and the selected auxiliary score;

calculating a coherence value between the current speech power spectrums of the main and the selected auxiliary audio signals: and if the first SAD and the second SAD are less than a third threshold value and the coherence value is close to 1, determining that the current speech power spectrums of the main and the selected auxiliary audio signals are similar, otherwise, determining that the current speech power spectrums of the main and the selected auxiliary audio signals are not similar.

27. The method according to claim 15, wherein distances between locations of the M auxiliary microphones and a user's mouth are Z times longer than a distance between locations of the main microphone and the user's mouth, and wherein Z>=2.

* * * * *